US007029330B1

(12) United States Patent
Ro

(10) Patent No.: US 7,029,330 B1
(45) Date of Patent: Apr. 18, 2006

(54) NON-GROUNDED ELECTRIC CONNECTOR

(75) Inventor: Young-Baik Ro, Hwasung (KR)

(73) Assignee: UJU Electronics Co. Ltd., Hwasung (KR)

( * ) Notice: Subject to any disclaimer, the term of this patent is extended or adjusted under 35 U.S.C. 154(b) by 0 days.

(21) Appl. No.: 11/161,381

(22) Filed: Aug. 1, 2005

(30) Foreign Application Priority Data

Dec. 23, 2004 (KR) ..... 10-2004-0111223

(51) Int. Cl.
*H01R 13/648* (2006.01)

(52) U.S. Cl. ..... 439/607; 439/148

(58) Field of Classification Search ..... 439/607, 439/148

See application file for complete search history.

(56) References Cited

U.S. PATENT DOCUMENTS 3,587,029 A * 6/1971 Knowles ..... 439/607
4,623,211 A * 11/1986 Dambach et al. ..... 439/607
4,687,263 A 8/1987 Cosmos et al.
4,747,787 A 5/1988 Siwinski
5,116,239 A 5/1992 Siwinski
5,509,827 A 4/1996 Huppenthal et al.
5,738,545 A 4/1998 Igarashi et al.
5,885,100 A * 3/1999 Talend et al. ..... 439/490
5,934,939 A * 8/1999 Thenaisie et al. ..... 439/607
5,984,698 A 11/1999 Hirata
6,066,000 A 5/2000 Masumoto et al.
6,120,323 A * 9/2000 Zhung et al. ..... 439/567
6,315,616 B1 11/2001 Hayashi
6,368,148 B1 4/2002 Fogg et al.
6,561,849 B1 * 5/2003 Naito et al. ..... 439/607

* cited by examiner

*Primary Examiner*—Tho D. Ta
(74) *Attorney, Agent, or Firm*—IPLA P.A.; James E. Bame

(57) ABSTRACT

Disclosed herein is an electric connector which is used for transmitting electromagnetic signals. The electric connector of the present invention includes a main body which has upper and lower guide bodies extending predetermined lengths, with an insertion slot formed in a first surface of the main body. The electric connector further includes a conductive cover which surrounds an outer surface of the main body. An edge of a part of the conductive cover, which faces the contact part of the main terminal contact and is placed at a position adjacent to the first surface of the main body, is bent into the insertion slot. The present invention has a structure to meet standard requirements and prevents an undesired part from contacting a plug connector, thus reducing the incidence of malfunction.

3 Claims, 5 Drawing Sheets

NON-GROUNDED ELECTRIC CONNECTOR

BACKGROUND OF THE INVENTION

1. Field of the Invention

The present invention relates generally to electric connectors which are used for connecting flexible cables or substrates to printed circuit boards and, more particularly, to an electric connector which has an improved structure and is used for transmitting electromagnetic signals.

2. Description of the Related Art

As well known to those skilled in the art, socket connectors includes main terminal contacts which transmit electromagnetic signals, and ground terminal contacts which are used for grounding. Typically, when the socket connectors are coupled to plug connectors, the main terminal contacts are connected to main contactors of the plug connectors and the ground terminal contacts are connected to ground contactors of the plug connectors.

A representative example of conventional electric connectors is shown in FIGS. 1 through 3. The construction of the representative example of conventional electric connectors will be explained with reference to FIGS. 1 through 3.

FIG. 1 is a perspective view showing the conventional electric connector. Referring to FIG. 1, the electric connector includes an insertion slot 2 which is formed in a first surface of a main body of the electric connector so that a plug connector (not shown) is inserted into the insertion slot 2. The electric connector further includes main terminal contacts 30 and ground terminal contacts 20 which are placed in the insertion slot 2 opposite to each other.

The main body having the insertion slot 2 includes an upper plate 12 and a lower plate 14 which respectively define upper and lower walls of the main body and are made of synthetic resin. The electric connector further includes a cover 10 which covers an upper surface of the upper plate 12, a lower surface of the lower plate 14 and outer surfaces of opposite ends of the main body.

The insertion slot 2 is formed in the first surface of the main body, and the ground terminal contacts 20 and the main terminal contacts 30, which are mounted in the main body, protrude to the outside from a second surface of the main body which is opposite to the first surface. Thus, protruded ends of both the ground terminal contacts 20 and the main terminal contacts 30 are mounted to a printed circuit board by soldering. Preferably, the protruded ends of the contacts 20 and 30 are bent in predetermined shapes such that the protruded ends are in surface contact with the printed circuit board. The protruded ends of both the ground terminal contacts 20 and the main terminal contacts 30 are alternately arranged at regular intervals, while the ground terminal contacts 20 and the main terminal contacts 30 are opposite to each other in the main body.

FIG. 2 is a partially broken perspective view of the electric connector of FIG. 1. As shown in FIG. 2, in the electric connector, the ground terminal contacts 20 are disposed on the lower plate 14 of the main body in line, and the main terminal contacts 30 are disposed under the upper plate 12 in line.

As such, the ground terminal contacts 20 and the main terminal contacts 30 face each other. The ground terminal contacts 20 and the main terminal contacts 30 are supported by a support plate which is placed between the contacts 20 and 30. Furthermore, the ground terminal contacts 20 and the main terminal contacts 30 have shapes such that, when contactors of the plug connector (not shown) are inserted between the ground terminal contacts 20 and the main terminal contacts 30, the ground terminal contacts 20 and the main terminal contacts 30 elastically push the contactors of the plug connector towards each other.

When the plug connector is inserted into the main body of the electric connector, the main terminal contacts 30, which transmit electromagnetic signals, come into contact with the main contactors of the plug connector. The ground terminal contacts 20 come into contact with ground contactors (not shown) of the plug connectors.

That it, the ground contactors of the plug connectors are provided at lower positions and the main contactors are provided at upper positions so as to correspond to the ground terminal contacts 20 and the main terminal contacts 30 which are placed at lower and upper positions, respectively.

Meanwhile, the ends of ground terminal contacts 20 protrude from the second surface of the main body and are spaced apart from each other at regular intervals. Here, as shown in FIG. 2, an end of one ground terminal contact 20 and ends of two main terminal contacts 20 are repeatedly and alternately arranged.

FIG. 3 is a perspective view showing the ground terminal contact 20 of the conventional electric connector. Referring to FIG. 3, the ground terminal contact 20 is made of a metal plate having a single body. The ground terminal contact 20 has a mounting lead 26 which protrudes through the second surface of the main body and is mounted to a printed circuit board by soldering, a fastening part 24 which is fastened to an inner wall of the main body, and a link part 22 which extends in a longitudinal direction of the main body so that a plurality of ground terminal contacts 20 may be coupled to each other through the link part 22.

Particularly, the ground terminal contact 20 further has inside contact ends 28 which are provided below the link part 22 and are bent towards the first surface of the main body and upwards at a predetermined angle. The inside contact ends 28 are placed on and supported by the lower plate 14 in the main body of the electric connector and face the main terminal contacts 30. When the plug connector is connected to the electric connector, the inside contact ends 28 come into contact with the ground contactors of the plug connector.

In conventional electric connectors having the above-mentioned construction, the ground terminal contacts 20 are disposed in line in the main body of the electric connector such that the ground terminal contacts 20 are opposite to the main terminal contacts 30 in the main body. However, to embody such a construction, a large number of ground terminal contacts 20 must be manufactured through a separate process and disposed in line in the main body of the electric connector. As such, in the conventional electric connector, there is a difficulty in manufacturing the electric connector.

Furthermore, due to a larger number of ground terminal contacts 20, or because the ground terminal contact 20 is long, the manufacturing cost of the electric connector is increased, and a process of manufacturing the electric connector is complicated. To solve these problems, it has been required to simplify the shape and structure of the ground terminal contact.

Meanwhile, typically, portable devices such as notebook computers have LCDs (liquid crystal display). The SPWG (standard panel working group) enacted the ISP guidelines (industrial standard panels) that standardize dimensions and interface of the LCDs, and is recommending that LCDs to be manufactured meet the ISP for reduction in development time and for sharing of information.

An electric connector of the present invention is also used for an LCD monitor, a notebook computer, etc. and is standardized. In detail, the electric connector of the present invention is standardized in that thirty-two terminal contacts must be arranged in line and two terminal contacts, which are placed at opposite ends, must be ground terminal contacts.

Therefore, even if the ground terminal contacts to be placed at opposite ends are unnecessary, the ground terminal contacts have to be provided to meet the standard. However, if each ground terminal contact has the same shape as that of the main terminal contact, an undesired part of the ground terminal contact may come into contact with the plug connector. Furthermore, even if the ground terminal contact is manufactured in a special shape to prevent an undesired part from contacting the plug connector, there is a problem in that a separate process of manufacturing the ground terminal contact is required.

In an effort to overcome the above-mentioned problems, an electric connector having improved ground terminal contacts was proposed. The improved electric connector will be described with reference to FIGS. 4 through 7.

FIG. 4 is a perspective view of the electric connector 100. FIG. 5 is front and right side views of the electric connector 100. Referring FIGS. 4 and 5, the electric connector 100 has upper and lower conductive covers 110 which are made of metal and surrounds an outer surface of a main body of the electric connector 100. In the same manner as that of the electric connector of FIG. 1, ground terminal contacts 120 and main terminal contacts 130 are mounted in the main body such that ends of them protrude from a second surface of the main body. Furthermore, an insertion slot (not shown), through which a plug connector (not shown) is inserted, is formed in a first surface of the main body.

Unlike the electric connector of FIG. 1, the ground terminal contacts 120 are placed at only opposite ends of the main body, and the main terminal contacts 130 are arranged between the ground terminal contacts 120.

FIG. 6 is a sectional view taken along the line A–A' of FIG. 5. As shown in FIG. 6, upper and lower surfaces of the main body are covered with the upper and lower conductive covers 110, respectively. The ground terminal contact 120 is provided in the main body and is in contact with a lower surface of the upper conductive cover 110.

The main body consists of upper and lower guide bodies 112 and 114 which define the insertion slot 102 therebetween. The lower conductive cover 110 covers the lower guide body 114. An edge of the lower conductive cover 110 which is placed at a position adjacent to the first surface of the main body is bent towards the insertion slot 102, that is, upwards. The upper conductive cover 110 covers the upper guide body 112. An edge of the upper conductive cover 110 which is placed at a position adjacent to the first surface of the main body is bent towards the insertion slot 102, that is, downwards.

Each ground terminal contact 120 protrudes from the second surface of the main body to the outside. Furthermore, the ground terminal contact 120 is in contact with the lower surface of the upper conductive cover 110 without protruding into the insertion slot 102.

FIG. 7 is a sectional view taken along the line B–B' of FIG. 5. As shown in FIG. 7, the upper and lower conductive covers 110 cover the upper and lower guide bodies 112 and 114 of the main body, respectively. Each main terminal contact 130 is provided in the main body below the upper conductive cover 110.

Unlike the electric connector of FIG. 1, there is no ground terminal contact below the main terminal contact 130. That is, only the lower guide body 114 faces the main terminal contact 130 without a ground terminal contact between them. Each main terminal contact 130 has a fastening part 136 which is held by the main body, thereby the main terminal contact 130 is fastened to the main body. The main terminal contact 130 further has a mounting lead 134 which protrudes from the second surface of the main body to the outside, and a contact part 132 which protrudes into the insertion slot 102 towards the first surface of the main body.

The lower conductive cover 110, which covers the lower guide body 114, has an extension part 110*a* which is bent upwards and extends to a position adjacent to the insertion slot 102. Preferably, the extension part 110*a* extends to a position right under the insertion slot 102. Alternatively, the extension part 110*a* may extend into the insertion slot 102 to a predetermined position.

However, even in the electric connector 100, there is a difficulty in manufacturing the electric connector 100, because the ground terminal contacts 120 must be manufactured such that each ground terminal contact 120 is bent upwards and contacts the upper conductive cover 110, unlike the main terminal contacts 130. Furthermore, because the extension part 110*a* of the lower conductive cover 110, which covers the lower guide body 114, protrudes merely upwards, when the plug connector is inserted into the insertion slot 102, the plug connector is not smoothly guided towards the main terminal contacts 130.

SUMMARY OF THE INVENTION

Accordingly, the present invention has been made keeping in mind the above problems occurring in the prior art, and an object of the present invention is to provide an electric connector which meets a standard and prevents an undesired part from contacting a plug connector.

Another object of the present invention is to provide an electric connector in which main contactors of the plug connector is connected to main terminal contacts more smoothly.

In order to accomplish the above object, the present invention provides a non-grounded electric connector, including: a main body, having upper and lower guide bodies extending predetermined lengths, with an insertion slot formed in a first surface of the main body; a plurality of main terminal contacts fastened to the main body and being parallel with the main body, each main terminal contact protruding at a second end thereof to an outside from a second surface opposite to the first surface of the main body, with a contact part provided on a first end of the main terminal contact which protrudes into the insertion slot towards the first surface of the main body and is spaced apart from the upper and lower guide bodies by predetermined distances; and a conductive cover surrounding an outer surface of the main body. An edge of a part of the conductive cover, which faces the contact part of the main terminal contact and is placed at a position adjacent to the first surface of the main body, is bent into the insertion slot.

The upper guide body may extend a predetermined length shorter than a position of the first end of the main terminal contact which protrudes into the insertion slot towards the first surface of the main body. An edge of an upper part of the conductive cover may be bent inwards and downwards around an end of the upper guide body adjacent to the first surface of the main body.

The lower guide body may extend a predetermined length shorter than a position of the first end of the main terminal contact which protrudes into the insertion slot towards the first surface of the main body. An edge of a lower part of the conductive cover may be bent inwards and upwards around an end of the lower guide body adjacent to the first surface of the main body.

The non-grounded electric connector may further include dummy contacts fastened to the main body and placed at outside opposite ends of a row of the main terminal contacts. Each dummy contact may protrude at a second end thereof to the outside from the second surface of the main body without protruding at a first end thereof towards the first surface of the main body.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
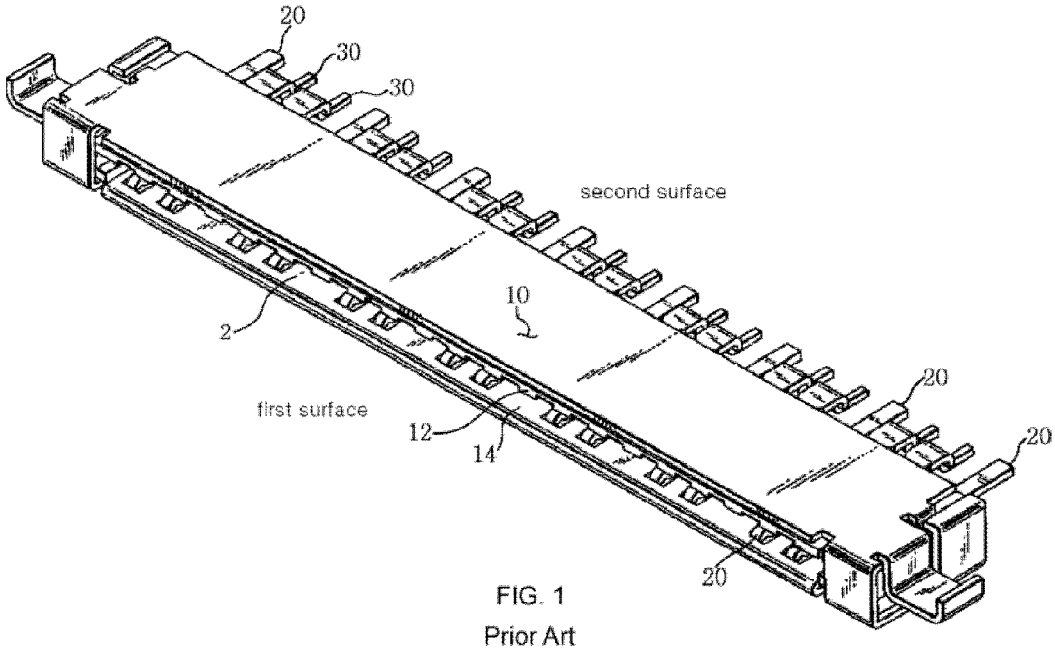
FIG. 1 Prior Art
FIG. 1 is a perspective view showing a conventional electric connector.
Figure 2:
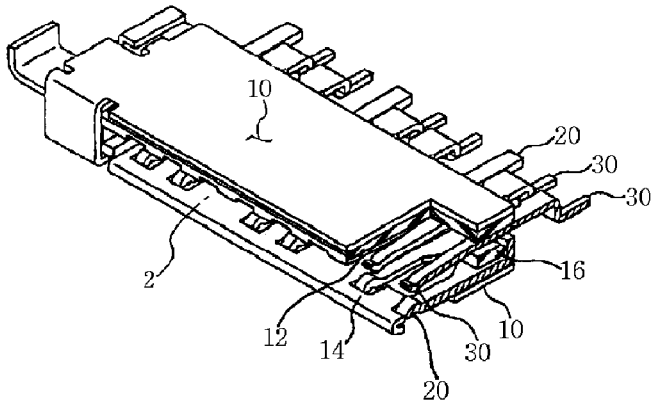
FIG. 2 Prior Art
FIG. 2 is a partially broken perspective view of the electric connector of FIG. 1.
Figure 3:
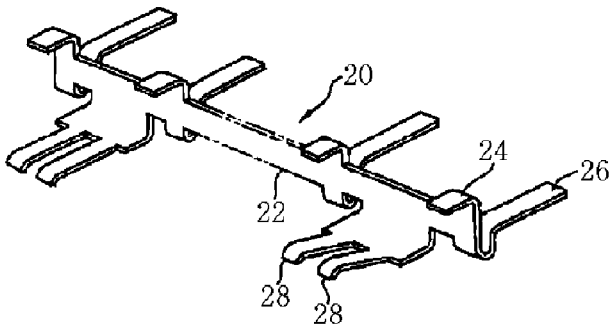
FIG. 3 Prior Art
FIG. 3 is a perspective view showing a ground terminal contact of the electric connector of FIG. 1.
Figure 4:
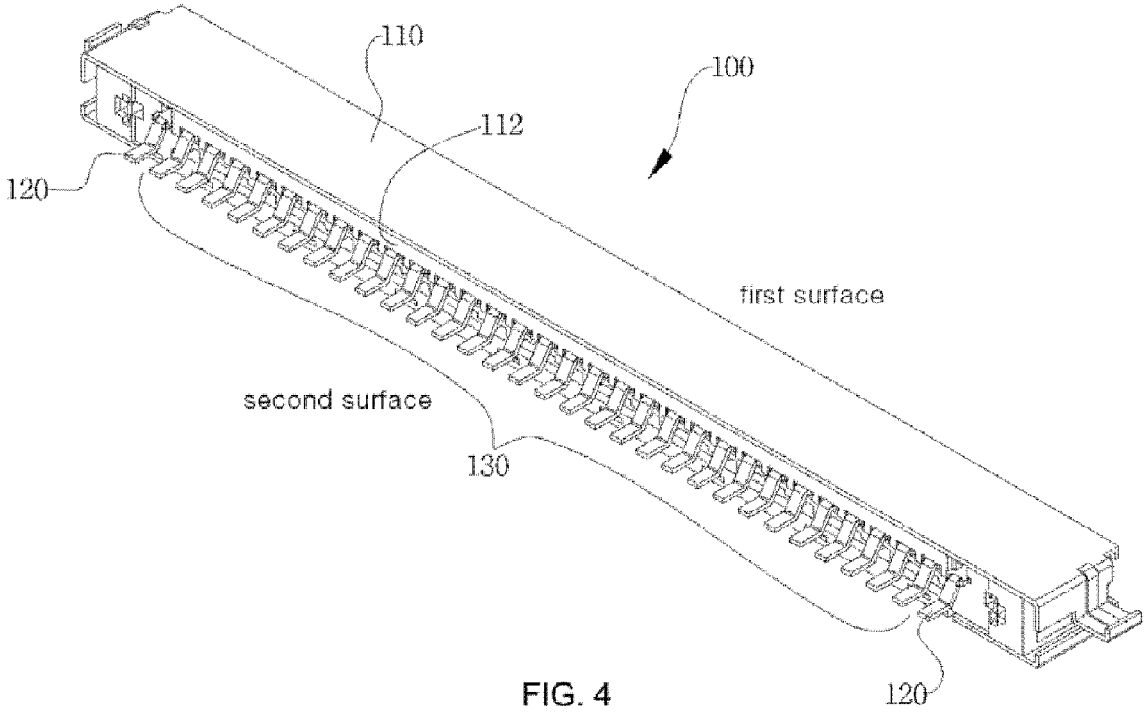
FIG. 4 Prior Art
FIG. 4 is a perspective view showing another conventional electric connector.
Figure 5:
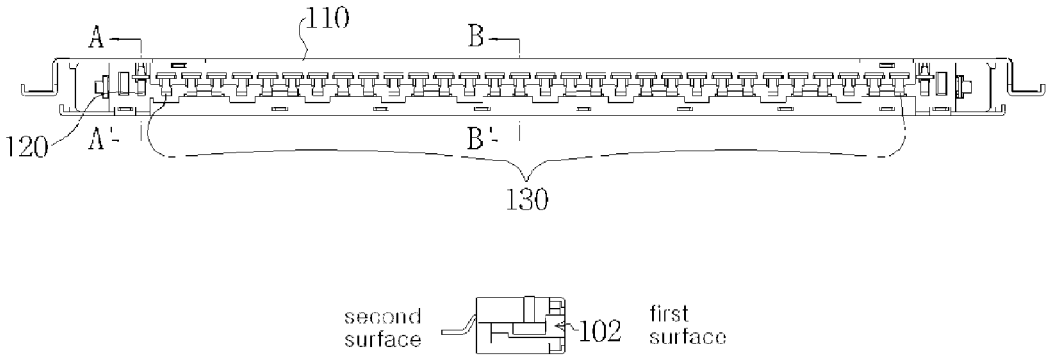
FIG. 5 Prior Art
FIG. 5 is front and right side views showing the electric connector of FIG. 4.
Figure 6:
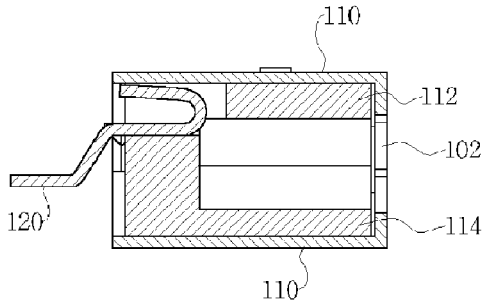
FIG. 6 Prior Art
FIG. 6 is a sectional view taken along the line A–A' of FIG. 5.
Figure 7:
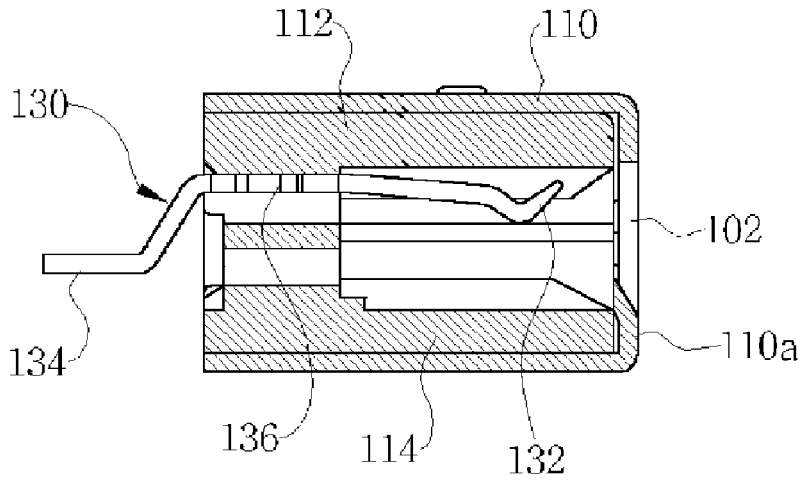
FIG. 7 Prior Art
FIG. 7 is a sectional view taken along the line B–B' of FIG. 5.
Figure 8:
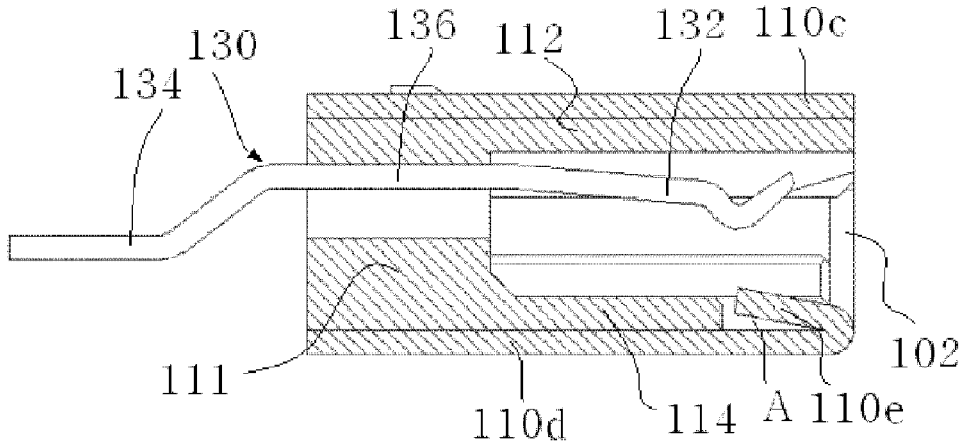
FIG. 8 is a transverse sectional view of an electric connector, according to a preferred embodiment of the present invention.

Hereinafter, a preferred embodiment of the present invention will be described in detail with reference to the attached drawings.

As such, because the lower guide body 114 is shorter than the upper guide body 112, a space (A) is defined on an edge of the lower guide body 114. In the space (A), an edge of the lower conductive cover 110*d* is bent inwards and upwards and then downwards, thus forming a bent part 110*e* that serves as the edge of the lower conductive cover 110*d*. That is, the bent part 110*e* or the edge of the lower conductive cover 110*d* is formed by bending the edge of the lower conductive cover 110*d* at an angle of about 150° or more. The bent part 110*e* acts like a plate spring, because the lower conductive cover 110*d* is made of metal having elasticity.

An upper surface of the upper guide body 112 and a lower surface of the lower guide body 114 are respectively covered with upper and lower conductive covers 110*c* and 110*d* which are made of metal. The upper guide body 112 extends longer than the protruded contact part 132 of the main terminal contact 130. The lower guide body 114 extends shorter than the protruded contact part 132 of the main terminal contact 130.

As such, because the lower guide body 114 is shorter than the upper guide body 112, a space (A) is defined on an edge of the lower guide body 114. In the space (A), an edge of the lower conductive cover 110*d* is bent inwards and upwards, thus forming a bent part 110*e*. That is, the bent part 110*e* of the lower conductive cover 110*d* is formed by bending the edge of the lower conductive cover 110*d* at an angle of about 150° or more. The bent part 110*e* acts like a plate spring, because the lower conductive cover 110*d* is made of metal having elasticity.

Therefore, when main contactors (not shown) of a plug connector are inserted into the main body 111 through an insertion slot 102, the bent part 110*e* of the lower conductive cover 110*d* elastically raises upwards the main contactors of the plug connector or a support portion that holds the main contactors. As a result, the main contactors of the plug connector can firmly contact the contact parts 132 of the main terminal contactors 130. Furthermore, the elasticity of the bent part 110*e* may be adjusted by a bending angle of the bent part 110*e*. As such, the present invention makes it possible for the plug connector to be smoothly inserted into the main body 111, thus preventing the main terminal contacts 130 or the main contactors of the plug connector from being damaged and deformed.

Figure 9:
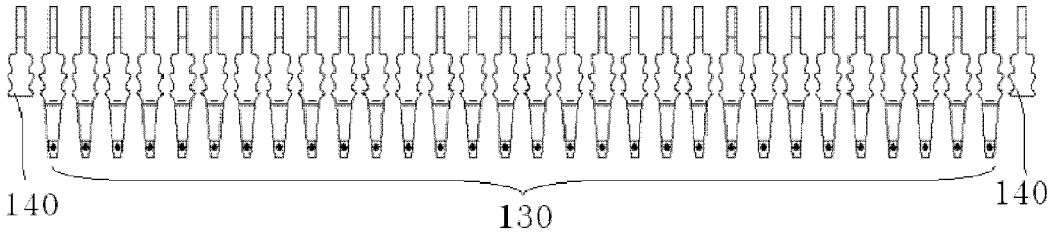
FIG. 9 is a plan view showing contacts of the electric connector which are arranged in a line according to the present invention.
Figure 10:
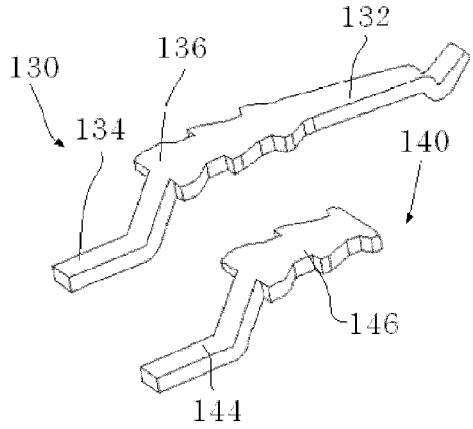
FIG. 10 is perspective views showing enlargements of a main terminal contact and a dummy contact of the electric connector according to the present invention.

FIG. 9 is a plan view showing contacts of the electric connector which are arranged in a line. FIG. 10 is perspective views showing enlargements of the main terminal contact 130 and a dummy contact 140 of the electric connector. Referring to FIGS. 9 and 10, thirty-two contacts are mounted to the main body 111. The thirty main terminal contacts 130 are placed at an intermediate position. Two dummy contacts 140 are placed at opposite outermost positions.

Each main terminal contact 130 includes the mounting lead 134, the fastening part 136 and the contact part 132. The contact part 132 protrudes from the fastening part 136, which is held by the main body 111. The main terminal contact 130 is connected to a main contactor of the plug connector (not shown) through the contact part 132.

Each dummy contact 140 has no contact part, unlike the main terminal contact 132 having the contact part 132 which protrudes into the insertion slot 102. The dummy contact 140 has only a mounting lead 144 and a fastening part 146 which is held by the main body 111. Because the dummy contact 140 has no contact part, the dummy contact 140 is not brought into contact with the plug connector. Furthermore, because thirty-two mounting leads 134 and 144 having the same shape are arranged in line, the present invention meets standard requirements.

As described above, the present invention provides an electric connector which has a structure to meet standard requirements and prevents an undesired part from contacting a plug connector, thus reducing the incidence of malfunction.

Furthermore, in the present invention, one of guide bodies constituting a main body is shorter than the other, thus defining a predetermined space. An edge of the conductive cover, which is placed at a position corresponding to the space defined due to the shorter guide body, is bent into the space, thus having elasticity like a plate spring. Therefore, the bent edge of the conductive cover helps main contactors of the plug connector smoothly come into contact with main terminal contacts of the electric connector of the present invention.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A non-grounded electric connector, comprising:

a main body, comprising upper and lower guide bodies extending predetermined lengths, with an insertion slot formed in a first surface of the main body;

a plurality of main terminal contacts fastened to the main body and being parallel with the main body, each main terminal contact protruding at a second end thereof to an outside from a second surface opposite to the first surface of the main body, with a contact part provided on a first end of the main terminal contact which protrudes into the insertion slot towards the first surface of the main body and is spaced apart from the upper and lower guide bodies by predetermined distances;

dummy contacts fastened to the main body and placed at outside opposite ends of a row of the main terminal contacts, each dummy contact protruding at a second end thereof to the outside from the second surface of the main body without protruding at a first end thereof towards the first surface of the main body; and a conductive cover surrounding an outer surface of the main body, wherein an edge of the conductive cover, which faces the contact part of the main terminal contact and is placed at a position adjacent to the first surface of the main body, is bent into the insertion slot.

2. The non-grounded electric connector as set forth in claim 1, wherein the edge of the conductive cover is bent inwards and upwards around an end of the lower guide body adjacent to the first surface of the main body.

3. The non-grounded electric connector as set forth in claim 1, wherein the bent-edge of the conductive cover serves as a plate spring.

* * * * *